US008123877B2

(12) United States Patent
Tanizawa et al.

(10) Patent No.: US 8,123,877 B2
(45) Date of Patent: Feb. 28, 2012

(54) HEAT-RESISTANT MAGNESIUM ALLOY FOR CASTING HEAT-RESISTANT MAGNESIUM ALLOY CAST PRODUCT, AND PROCESS FOR PRODUCING HEAT-RESISTANT MAGNESIUM ALLOY CAST PRODUCT

(75) Inventors: Motoharu Tanizawa, Kariya (JP); Kyoichi Kinoshita, Kariya (JP); Eiji Kishi, Kariya (JP); Katsufumi Tanaka, Kariya (JP); Yuki Okamoto, Kariya (JP); Takayuki Kato, Kariya (JP)

(73) Assignee: Kabushiki Kaisha Toyota Jidoshokki, Aichi-Ken (JP)

( * ) Notice: Subject to any disclaimer, the term of this patent is extended or adjusted under 35 U.S.C. 154(b) by 886 days.

(21) Appl. No.: 11/975,381

(22) Filed: Oct. 18, 2007

(65) Prior Publication Data

US 2008/0187454 A1 Aug. 7, 2008

Related U.S. Application Data

(63) Continuation-in-part of application No. 10/763,686, filed on Jan. 23, 2004, now abandoned.

(30) Foreign Application Priority Data

Jan. 31, 2003 (JP) ..... 2003-24095

(51) Int. Cl.
*C22F 1/06* (2006.01)
*C22C 23/02* (2006.01)

(52) U.S. Cl. ..... 148/539; 148/666; 148/667; 148/420

(58) Field of Classification Search ..... 148/539, 148/666, 667, 420
See application file for complete search history.

(56) References Cited

U.S. PATENT DOCUMENTS 4,997,622 A 3/1991 Regazzoni et al.
5,073,207 A 12/1991 Faure et al.

FOREIGN PATENT DOCUMENTS

DE 1 184 508 12/1964
DE 1 608 193 12/1970
EP 0 419 375 3/1991
EP 0 799 901 10/1997

(Continued)

OTHER PUBLICATIONS

Database WPI/Derwent Section Ch, Week Sep. 1994, Derwent Publications Ltd., London, GB; AN 1994-072288, JP06025790.

(Continued)

*Primary Examiner* — Sikyin Ip
(74) *Attorney, Agent, or Firm* — Locke Lord LLP

(57) ABSTRACT

A heat-resistant magnesium alloy is for casting, and includes Ca in an amount of from 1 to 15% by mass, Al in a summed amount of from 4 to 25% by mass with the amount of Ca, and the balance being Mg and inevitable impurities when the entirety is taken as 100% by mass. The heat-resistant magnesium alloy is not only inexpensive, but also effects an advantage that cracks are inhibited from occurring when being cast. For example, a process for producing heat-resistant magnesium alloy cast product includes the step of pressure pouring an alloy molten metal, which has a target composition around Mg—3% Ca—3% Al—from 0.2 to 0.3% Mn, into a cavity of metallic die, which is preheated to a die temperature of from 130 to 140° C. in advance. The process makes it possible to produce die-cast products, which are free from cast cracks.

1 Claim, 8 Drawing Sheets
(3 of 8 Drawing Sheet(s) Filed in Color)

FOREIGN PATENT DOCUMENTS

| | | |
|---|---|---|
| EP | 0 990 710 | 4/2000 |
| EP | 1 048 743 | 11/2000 |
| EP | 1 060 817 | 12/2000 |
| JP | 06-025790 | 2/1994 |
| JP | 08-269609 | 10/1996 |
| JP | 09-271919 | 10/1997 |
| JP | 9-272945 | 10/1997 |
| JP | 2000-104137 | 4/2000 |
| JP | 2000-280043 | 10/2000 |
| JP | 2000-280057 | 10/2000 |
| JP | 2000-319744 | 11/2000 |
| JP | 3 229 954 | 9/2001 |
| JP | 2001-316753 | 11/2001 |
| JP | 2002-129272 | 5/2002 |
| JP | 2002-275569 | 9/2002 |
| JP | 2004-162090 | 6/2004 |
| JP | 07-118785 | 5/2005 |
| WO | WO 89/08154 | 9/1989 |

OTHER PUBLICATIONS

Official letter & English Translation citing EP 1 048 743, published Nov. 2, 2000.

HEAT-RESISTANT MAGNESIUM ALLOY FOR CASTING HEAT-RESISTANT MAGNESIUM ALLOY CAST PRODUCT, AND PROCESS FOR PRODUCING HEAT-RESISTANT MAGNESIUM ALLOY CAST PRODUCT

This application is a continuation-in-part of application Ser. No. 10/763,686, filed on Jan. 23, 2004, now abandoned, the subject matter of which is hereby incorporated in its entirety by reference.

BACKGROUND OF THE INVENTION

1. Field of the Invention

The present invention relates to a heat-resistant magnesium alloy which can inhibit cracks when being cast, and which is good in terms of the castability and heat resistance.

2. Description of the Related Art

Due to the recent increasing weight reduction need, magnesium alloys which are much lighter than aluminum alloys have been attracting the attention of engineers. Magnesium alloys are the most lightweight among practical metals, and are about to be used as automotive materials in addition to aeronautical materials. For example, magnesium alloys are used in automobile wheels and engine head covers. In addition to these, as the environmental consciousness has been enhanced recently, it has been required to further make vehicles lightweight. Accordingly, it has come to examine to use magnesium alloys even for appliances or apparatuses which are used in high-temperature regions. In this instance, the heat resistance of magnesium alloys matters naturally. For instance, AZ91 as per Japanese Industrial Standard, a general magnesium alloy, exhibits such a very low creep strength that it is not appropriate for component parts which are used in high temperature environments. Consequently, AE42 as per the standard of the Dow Chemical Company of the United States of America is available as one of such materials whose heat resistance is improved. Moreover, Japanese Patent Publication No. 3,229,954, Japanese Unexamined Patent Publication (KOKAI) No. 2002-129,272 and Japanese Unexamined Patent Publication (KOKAI) No. 2002-275,569 propose magnesium alloys which are good in terms of the anti-creep strength or the other properties.

All of these magnesium alloys include rare-earth elements (hereinafter abbreviated to as "R.E." wherever appropriate) in an amount of from 0.5 to 3% by mass approximately. Rare-earth elements are surely effective elements in improving the heat resistance of magnesium alloys.

However, rare-earth elements are so expensive that they raise the cost of magnesium alloys and their cast products. Moreover, according to the survey and study carried out by the present inventors, rare-earth elements are found to be elements which are likely to cause cracks in casting alloys. Accordingly, it is not preferable to have rare-earth elements contained in cast alloys. In addition, the present inventors have come to know newly that it is possible to produce heat resistance, such as sufficient creep resistance, without including rare-earth elements in magnesium alloys.

SUMMARY OF THE INVENTION

The present invention has been developed in view of such circumstances. It is therefore an object of the present invention to provide a heat-resistant magnesium alloy for casting, magnesium alloy which can inhibit the occurrence of cracks when being cast, and which is good in terms of the castability, not to mention the heat resistance, without using rare-earth elements but by using elements being less expensive than rare-earth elements. Moreover, it is a further object of the present invention to simultaneously provide a magnesium alloy cast product which is cast by using the magnesium alloy. In addition, it is a furthermore object of the present invention to provide a process for producing a heat-resistant magnesium alloy cast product comprising the magnesium alloy.

Hence, the inventors of the present invention studied wholeheartedly in order to solve the problem, and carried out a variety of systematic experiments repeatedly. As a result, when only Al and Ca, which are less expensive fundamentally, are contained in magnesium alloys in an appropriate amount, respectively, they found out that it is possible to produce magnesium alloys which exhibit sufficient heat resistance and simultaneously which is good in terms of the castability so that cracks are less likely to occur in casting. Based on the discovery, they arrived at completing the present invention.

Heat-Resistant Magnesium Alloy for Casting

For example, a heat-resistant alloy according to the present invention is for casting, is good in terms of the castability and heat resistance, and comprises:

calcium (Ca) in an amount of from 1 to 15% by mass;

aluminum (Al) in a summed amount of from 4 to 25% by mass with the amount of Ca; and the balance being magnesium (Mg) and inevitable impurities when the entirety is taken as 100% by mass (hereinafter simply referred to as "%").

The present heat-resistant magnesium alloy does not contain expensive "R.E." Moreover, since the requisite elements of the present heat-resistant magnesium alloy are only Ca and Al, the present heat-resistant magnesium alloy and heat-resistant magnesium alloy cast products made of the same are less expensive and are remarkably good in terms of the cost competitiveness even when not only the material cost and but also the production cost are taken into consideration. In addition, the present heat-resistant magnesium alloy not only demonstrates sufficient heat resistance but also effects an advantage that cracks are inhibited from occurring in casting as described above.

Incidentally, it is not necessarily clear why the present heat-resistant magnesium alloy exhibits good heat resistance and castability when it contains only Ca and Al in an amount falling in the aforementioned range, respectively. However, it is believed at present as hereinafter described.

First, the reasons why the present heat-resistant magnesium alloy is good in terms of the heat resistance will be hereinafter described.

Al is an important element in view of improving the room-temperature strength of magnesium alloys when it solves in magnesium crystalline grains. Moreover, Al is an important element in view of upgrading the corrosion resistance of magnesium alloys. However, when the Al content increases in magnesium alloys, Al turns into Mg—Al compounds, such as $Mg_{17}Al_{12}$, to precipitate in the magnesium matrix or magnesium crystalline grain boundaries. When such magnesium alloys are left in a high-temperature region for a long period of time, the intermetallic compounds enlarge the creep deformation of magnesium alloys. That is, the heat resistance of magnesium alloys is lowered.

Ca produces an effect of inhibiting the heat-resistance decrement accompanied by the Al content increment. This is believed to result from the fact that Ca reacts with the Mg—Al compounds and matrices to decrease $Mg_{17}Al_{12}$, which causes to lower creep characteristics, and simultaneously to form Ca—Al compounds and Mg—Ca compounds, which are stable in a high-temperature region. These intermetallic compounds crystallize or precipitate mainly in crystalline grain boundaries in a network manner, and are accordingly believed to exert the wedge action of preventing the dislocation movement of magnesium alloys.

Due to the above-described reasons, the present magnesium alloy is believed to exhibit such good heat resistance that it undergoes the creep deformation less even in a high-temperature region when it comprises Al and Ca in an appropriate amount, respectively.

Next, the reasons why the present magnesium alloy is good in terms of the castability will be hereinafter described. Note that the "castability" referred to in the present specification designates whether cracks occur or not in casting. The cracks in casting can be classified as so-called hot cracks and shrinkage cracks. The hot cracks are cracks that occur when liquid-phase portions undergo volumetric contraction in the state of solid-liquid coexistence. Accordingly, dendritic structures or tree-like structures appear in fracture surfaces. On the other hand, the shrinkage cracks occur in the state free from liquid phases when being ruptured by casting residual stresses. Consequently, fracture surfaces are brittle fracture surfaces free from dendritic structures. Unless otherwise specified, both cracks are simply referred to as casting cracks in the present specification without distinction. However, it is possible to say daringly that the hot cracks will be hereinafter considered primarily. This interpretation can be derived from the following fact. Since the hot cracks are affected greatly by the characteristics of magnesium alloys per se, it is difficult to solve the hot cracks by reviewing casting designs and production processes. On the contrarily, it is often possible to solve the shrinkage cracks by devising or elaborating mold configurations and casting methods. Indeed, the present magnesium alloy produces advantages not only in inhibiting the hot cracks but also in practically inhibiting the shrinkage cracks sufficiently. Hereinafter, the present magnesium alloy will be described with a focus on how it inhibits the casting cracks.

The present inventors first thought of narrowing the solidification temperature width of magnesium alloys in order to inhibit the casting cracks. The solidification temperature width is the temperature difference between the liquidus temperature at which molten metals start solidifying and the solidus temperature at which molten metals complete solidifying. When the solidification temperature width is narrowed, it is possible to effect advantages in inhibiting the casting cracks because the shrinkage stresses decrease when the molten metal of magnesium alloys solidifies. In order to narrow the solidification temperature width, it is required to increase the solidus temperature of magnesium alloys and to decrease the liquidus temperature.

According to the surveys and studies carried out by the present inventors, the solidus temperature of the present magnesium alloy (e.g., an Mg—Ca—Al ternary alloy) is influenced strongly by Ca. Specifically, when Ca is contained less, the solidus temperature increases sharply to around 515° C. When Al is added thereto, the solidus temperature increases in accordance with the Al addition, though the increment is gentle. For example, when the Ca content and the Al content are equivalent substantially like an Mg—3% by mass Ca—3% by mass Al alloy, namely, when the Al/Ca ratio by mass is 1 virtually, it was understood that the influence of Ca is predominant so that the solidus temperature is a temperature (e.g., about 515° C.) which is determined by the Mg—Ca binary phase diagram. Moreover, when the mass proportion of Al with respect to Ca, the Al/Ca ratio by mass, is 3 or more, the influence of Al is added moderately so that the solidus temperature increases to about 530° C. approximately. It is believed that Ca influences the solidus temperature strongly because the solidus temperature is constant substantially, at about 515° C., in the Mg—Ca binary phase diagram when the Ca content falls in the claimed range according to the present invention.

On the other hand, regarding the liquidus temperature, Ca acts somewhat more strongly to lower the liquidus temperature than Al does, Ca and Al work cooperatively to influence the liquidus temperature as a whole. For example, an Mg—3% by mass Al—3% by mass Ca alloy exhibited a liquid temperature of 620° C.; an Mg—6% by mass Al—3% by mass Ca alloy exhibited a liquid temperature of 603° C.; and an Mg—3% by mass Al—9% by mass Ca alloy exhibited a liquid temperature of 581° C.

From the facts, in order to narrow the solidification temperature width, it is important to have Ca contained in an amount of 1% by mass or more so as to increase the solidus temperature to 515° C. or more; and to control the summed amount of Ca and Al to a predetermined amount or more so as to properly decrease the liquidus temperature. Since it is natural that the more the contents of Ca and Al increase the higher the solidus temperature increases but the lower the liquidus temperature decreases, it is preferable if only the solidification temperature width can be narrowed simply. However, when the contents of Ca and Al increase too much, it is not preferable economically because the cost of magnesium alloys has gone up. Moreover, when the content of Al increases too much with respect to the content of Ca, it is not preferable because it results in lowering the heat resistance of magnesium alloys as described above. In addition, when the content of Ca increases too much, there arise fears of lowering the molten metal flowability, fusing with molds and lowering the elongation.

In view of both heat resistance and castability, the contents of Ca and Al, the requisite elements, are controlled in the present heat-resistant magnesium alloy so that the content of Ca falls in a range of from 1 to 15% by mass, i.e., Ca: 1-15% by mass; and the summed content of Ca and Al falls in a range of from 4 to 25% by mass, i.e., 4% by mass≦Ca+Al≦25% by mass. The composition can be interpreted as Ca: 1-15% by mass and Al: 3-10% by mass. The lower limit of the Ca content can preferably be 2% by mass, further 3% by mass; and the upper limit can preferably be 10% by mass, further 9% by mass. Moreover, the lower limit of the summed content of Ca and Al can preferably be 5% by mass, further 6% by mass, furthermore 9% by mass; and the upper limit can preferably be 20% by mass, further 18% by mass, furthermore 12% by mass. In addition, focusing on the Al content specifically, the lower limit can preferably be 4% by mass, further 5% by mass; and the upper limit can preferably be 10% by mass, further 9% by mass.

When the content of Al is more than the content of Ca, it is not possible to sufficiently inhibit the $Mg_{17}Al_{12}$ from precipitating so that the creep resistance of magnesium alloys is lowered as described above. Accordingly, it is preferred that the mass ratio of the Ca content with respect to the Al content, Ca/Al by mass, can be 1 or more, further 2 or more, furthermore 3 or more.

Since the present heat-resistant magnesium alloy has the above-described composition, it exhibits a solidification temperature width of 110° C. or less, further 100° C. or less, furthermore 90° C. or less, moreover 80° C. or less, still further 75° C. or less. When the solidification temperature width narrows as such, it means that the cooling rate enhances and the solidifying time shortens in all casting methods, contrary to the case where the cooling rate is simply increased in a specific casting method. Specifically speaking, the solidifying time shortens even in the gravity casting whose cooling rate is relatively slow, and shortens even more in the die-cast casting whose cooling rate is very fast. Since the solidifying time thus shortens, it is believed that the shrinkage stresses are suppressed in solidifying the molten metal so that the casting cracks are inhibited.

Moreover, when the present inventors observed the structure of cast products composed of the present heat-resistant magnesium alloy, it was verified that the structure was made finer remarkably. It is believed that the solidifying time shortened as described above is one of the causes of this phenomenon but the composition of the present heat-resistant magnesium alloy as well affects the finer structure. The belief is because of the fact that the structure was not made finer so much when it contained R.E. even if the solidification temperature width was lowered to 80° C. approximately. Therefore, making the structural roughness finer is believed to be effective in inhibiting the casting cracks. Since the structural roughness can be indexed with the average crystalline grain diameter, it is believed to be much more effective in order to inhibit the casting cracks when the average crystalline grain diameter is diminished more so as to be 18 μm or less, further 16 μm or less, furthermore 14 μm or less, moreover 12 μm or less, still further 10 μm or less.

The present heat-resistant magnesium alloy can further comprise Mn. Mn is an element which solves into Mg crystalline grains to subject magnesium alloys to solid-solution strengthening. Moreover, Mn reacts with Al as well to inhibit $Mg_{17}Al_{12}$, one of the causes of lowering the creep strength or creep resistance, from precipitating and simultaneously form thermally stable intermetallic compounds. Due to the actions, Mn is an element which can improve not only the room-temperature strength of magnesium alloys but also the high-temperature strength. In addition, Mn does not adversely affect the castability of magnesium alloys. Besides, Mn produces an advantage of removing Fe, one of the impurities which cause corrosion, by sedimentation. When the present heat-resistant magnesium alloy comprises Mn too less, the advantages are effected less. When the present heat-resistant magnesium alloy comprises Mn in an amount of more than 1% by mass, not only the advantages cannot be expected to upgrade but also it is not economical. Hence, it is appropriate that the present heat-resistance magnesium alloy can contain Mn in an amount of from 0.1 to 1% by mass, further from 0.2 to 0.7% by mass.

Heat-Resistant Magnesium Alloy Cast Product

Not limited to the above-described present heat-resistance magnesium alloy for casting, it is possible to grasp the present invention as a cast product comprising the same. The cast product is made with the present heat-resistant magnesium alloy as a raw material.

For instance, a heat-resistant magnesium alloy cast product according the present invention is produced by a process comprising the steps of:

pouring a molten alloy into a mold, the molten alloy comprising:

Ca in an amount of from 1 to 15%;

Al in a summed amount of from 4 to 25% with the Ca amount; and the balance being Mg and inevitable impurities when the entirety is taken as 100%; and solidifying the molten alloy by cooling it after the pouring step.

The present heat-resistant magnesium alloy cast product is not limited to those made by the ordinary gravity casting or pressure casting, but can be those made by the die casting. Note that the terms, "for casting" and "castability" referred to in the present specification, are applicable to any casting method. Moreover, a mold used in casting does not matter whether it is sand molds or metallic molds.

In addition, the "heat resistance" set forth in the present specification is assessed by the mechanical qualities of magnesium alloys in a high-temperature atmosphere, for example, the creep characteristics or high-temperature strength which are examined by a stress relaxation test or an axial tension retention test.

In the present specification, when the composition range of the respective elements is specified in a form of "from x to y % by mass," it means to include the lower limit "x" and the upper limit "y" unless otherwise specified.

The application of the present heat-resistant magnesium alloy extends to various fields, such as automobiles and home electric appliances, starting with space, military and aeronautic fields. Indeed, it is more appropriate to use the present heat-resistant magnesium alloy for products used in high-temperature environments, such as engines, transmissions, air-conditioning compressors which are disposed in automotive engine rooms, or products related to them, by making the active use of the heat resistance.

Process for Producing Heat-Resistant Magnesium Alloy Cast Product

The present inventors found out that, among the above-described magnesium alloys, magnesium alloy cast products, which have such an elemental composition as Mg—3% Ca—3% Al—from 0.2 to 0.3% Mn or elemental compositions falling around the specific elemental composition, are remarkably good in terms of the castability and heat resistance.

In addition to the above finding, as a result of the present inventors' further continuous earnest study, the present inventors found out anew that, when casting magnesium alloy cast products with compositions falling within such an elemental composition range, controlling the temperature of casting die (or die temperature) appropriately makes it possible to further enhance the above-described castability and the mechanical characteristics of cast products. Thus, in addition to the above-described present magnesium alloy and cast products being made thereof, the present inventors completed the following invention as well with regard to processes for producing heat-resistant magnesium alloy cast product.

Firstly, the newly established present invention relates to a process for producing heat-resistant magnesium alloy cast product by means of die casting, liquid forging and centrifugal casting.

Specifically, a process according to a first aspect of the newly established present invention for producing heat-resistant magnesium alloy cast product comprises the steps of: preparing an alloy molten metal including calcium (Ca), aluminum (Al), manganese (Mn) and magnesium (Mg); pouring the alloy molten metal into a preheated casting die; and solidifying the alloy molten metal undergone the pouring step by cooling;

the casting die comprises a metallic die with a cavity provided therein;

the pouring step comprises a step of pressure pouring the alloy molten metal into the cavity of the metallic die, which is preheated to a die temperature of from 130 to 140° C.; and thereby a heat-resistant magnesium alloy cast product is obtainable, the heat-resistant magnesium alloy cast product comprising: from 2.5 to 3.5%-by-mass Ca; from 2.5 to 3.5%-by-mass Al; from 0.1 to 0.5%-by-mass Mn; and the balance being Mg as well as inevitable impurities and/or trace-amount reforming elements being effective for improving characteristics; when the entirety is taken as 100% by mass (hereinafter simply referred to as "%").

Like the first aspect of the newly established present invention, when an alloy molten metal is poured into a cavity of a metallic die, which is preheated to a die temperature of from 130 to 140° C. and then casting is carried out, it is possible to inhibit cast cracks from occurring remarkably. If the die temperature is too low or too high, cast cracks are likely to occur. Note that the cast cracks being referred to herein are believed to be the above-described hot cracks mainly. However, in the first aspect of the newly established present invention, the types of the cracks do not matter at all.

In addition to 145° C., the upper limit of the die temperature can preferably be 142° C., 140° C., 139° C., 138° C., and further 137° C. In addition to 130° C., the lower limit of the die temperature can preferably be 131° C., 132° C., and further 133° C.

Incidentally, when casting heat-resistant magnesium alloy cast products as described above, the molten-metal temperature of the alloy molten metal to be poured is not limited in particular. However, when the molten-metal temperature is too low, the viscosity of the alloy molten metal heightens to degrade the molten-metal flowability or molten-metal circulatability so that it is difficult to carry out casting. On the contrary, the molten-metal temperature being too high is not preferable, because the seizure occurs between metallic die and cast product, or because the metallic die or jig is likely to suffer from deterioration, such as wear or damage, which results from the high-temperature alloy molten metal.

Hence, in the first aspect of the newly established present invention, it is preferable to control the temperature of the alloy molten metal to be pressure poured into the cavity of the metallic die so as to fall within a range of from 620 to 640° C. In addition to 640° C., the upper limit of the molten-metal temperature of the alloy molten metal can preferably be 638° C., 635° C., and further 633° C. Moreover, in addition to 620° C., the lower limit of the molten-metal temperature can preferably be 622° C., 625° C., and further 628° C.

Secondly, the newly established present invention relates to a process for producing heat-resistant magnesium alloy cast product by means of gravity casting in which a molten metal is poured into a casting die without pressurizing the molten metal especially, thereby casting a heat-resistant magnesium alloy cast product. In particular, it relates to such a production process in which a metallic die is used for the casting die.

Specifically, a process according to a second aspect of the newly established present invention for producing heat-resistant magnesium alloy cast product comprises the steps of: preparing an alloy molten metal including Ca, Al, Mn and Mg; pouring the alloy molten metal into a preheated casting die; and solidifying the alloy molten metal undergone the pouring step by cooling;

the casting die comprises a metallic die with a cavity provided therein;

the pouring step comprises a step of gravity pouring the alloy molten metal into the cavity of the metallic die, which is preheated to a die temperature of from 30 to 450° C.; and thereby a heat-resistant magnesium alloy cast product is obtainable, the heat-resistant magnesium alloy cast product comprising: from 2.5 to 3.5% Ca; from 2.5 to 3.5% Al; from 0.1 to 0.5% Mn; and the balance being Mg as well as inevitable impurities and/or trace-amount reforming elements being effective for improving characteristics; when the entirety is taken as 100%.

Like the second aspect of the newly established present invention, when an alloy molten metal is poured into a cavity of a metallic die, which is preheated to a die temperature of from 30 to 450° C. and then casting is carried out, the molten-metal flowability or molten-metal circulatability improves so that it is possible to inhibit the occurrence of cast defects, such as cast cracks, remarkably.

If the die temperature is too low, the molten-metal flowability or molten-metal circulatability worsens so that cast defects are likely to occur. Moreover, when the die temperature is too high, cast defects, such as cast cracks and blow holes, are likely to occur in the bottom surface of cast product or inside thereof. Note that the cast cracks being referred to herein are also believed to be the above-described hot cracks mainly. However, in the second aspect of the newly established present invention, the types of the cracks do not matter at all.

In addition to 450° C., the upper limit of the die temperature can preferably be 400° C., 350° C., 300° C., 250° C., 200° C., and further 150° C. In addition to 30° C., the lower limit of the die temperature can preferably be 35° C., 40° C., 45° C., 50° C., 55° C., 60° C., 70° C., 80° C., 90° C., 100° C., and further 125° C.

Incidentally, when casting heat-resistant magnesium alloy cast products as described above, the molten-metal temperature of the alloy molten metal to be poured is not limited in particular. However, when the molten-metal temperature is too low, the viscosity of the alloy molten metal heightens to degrade the castability, such as the molten-metal flowability or molten-metal circulatability. On the contrary, the molten-metal temperature being too high is not preferable, because the seizure occurs between metallic die and cast product, or because the metallic die or jig is likely to suffer from deterioration, such as wear or damage, which results from the high-temperature alloy molten metal.

Hence, in the second aspect of the newly established present invention, it is preferable to control the temperature of the alloy molten metal to be gravity poured into the cavity of the metallic die so as to fall within a range of from 630 to 750° C. In addition to 750° C., the upper limit of the molten-metal temperature of the alloy molten metal can preferably be 740° C., 730° C., 720° C., and further 710° C. Moreover, in addition to 630° C., the lower limit of the molten-metal temperature can preferably be 640° C., 650° C., 660° C., 670° C., 680° C., and further 690° C.

Thirdly, the newly established present invention relates to a process for producing heat-resistant magnesium alloy cast product by means of gravity casting in which a molten metal is poured into a casting die without pressurizing the molten metal especially, thereby casting a heat-resistant magnesium alloy cast product. In particular, it relates to such a production process in which a sand die is used for the casting die.

Specifically, a process according to a third aspect of the newly established present invention for producing heat-resistant magnesium alloy cast product comprises the steps of: preparing an alloy molten metal including Ca, Al, Mn and Mg; pouring the alloy molten metal into a preheated casting die; and solidifying the alloy molten metal undergone the pouring step by cooling;

the casting die comprises a sand die with a cavity provided therein;

the pouring step comprises a step of gravity pouring the alloy molten metal into the cavity of the sand die, which is preheated to a die temperature of from 30 to 350° C.; and thereby a heat-resistant magnesium alloy cast product is obtainable, the heat-resistant magnesium alloy cast product comprising: from 2.5 to 3.5% Ca; from 2.5 to 3.5% Al; from 0.1 to 0.5% Mn; and the balance being Mg as well as inevitable impurities and/or trace-amount reforming elements being effective for improving characteristics; when the entirety is taken as 100%.

Like the third aspect of the newly established present invention, when an alloy molten metal is poured into a cavity of a sand die, which is preheated to a die temperature of from 30 to 350° C. and then casting is carried out, the molten-metal flowability or molten-metal circulatability improves so that it is possible to inhibit the occurrence of cast defects, such as cast cracks, remarkably.

If the die temperature is too low, the molten-metal flowability worsens so that cast defects, such as the colt shut and the faulty molten-metal circulation, are likely to occur. Moreover, when the die temperature is too high, there is a fear that the resulting cast products might exhibit degraded strength, which results from the coarsening of crystalline particles and the shrinkage cavities. In addition, there is another fear that the sand die might exhibit degraded strength so that cast defects, which result from dropped-off (or collapsed) sand die, might occur. Note that "cold shut" herein refers to such a boundary that is made when a molten metal does not solve completely at the confluence of the molten-metal flow within a casting die.

In addition to 350° C., the upper limit of the die temperature can preferably be 320° C., 300° C., 250° C., 220° C., 200° C., 150° C., 140° C., 130° C., 120° C., and further 115° C. In addition to 30° C., the lower limit of the die temperature can preferably be 40° C., 50° C., 60° C., 70° C., 80° C., and further 85° C.

Incidentally, when forming heat-resistant magnesium alloy cast products as described above, the molten-metal temperature of the alloy molten metal to be poured is not limited in particular. However, when the molten-metal temperature is too low, the viscosity of the alloy molten metal heightens to degrade the castability, such as the molten-metal flowability or molten-metal circulatability. On the contrary, the molten-metal temperature being too high is not preferable, because the jig is likely to suffer from deterioration, such as wear or damage, which results from the high-temperature alloy molten metal.

Hence, in the third aspect of the newly established present invention, it is preferable to control the temperature of the alloy molten metal to be gravity poured into the cavity of the sand die so as to fall within a range of from 630 to 750° C. In addition to 750° C., the upper limit of the molten-metal temperature of the alloy molten metal can preferably be 740° C., 730° C., 720° C., and further 710° C. Moreover, in addition to 630° C., the lower limit of the molten-metal temperature can preferably be 640° C., 650° C., 660° C., 670° C., 680° C., and further 690° C.

The "trace-amount modifying elements" set forth in the newly established present invention are elements that are effective for improving characteristics. For example, the "trace-amount modifying elements" are elements that contribute to the mechanical characteristics of magnesium alloy cast product, such as the room-temperature strength, the high-temperature strength, the high-temperature durability (or creep strength), the toughness and the elongation. Moreover, the "trace-amount modifying elements" can even be elements that contribute to the castability, that is, the molten-metal flowability upon casting, or to the inhibition of cast defects, such as cracks or gas cavities. In addition, the "trace-amount modifying elements" can even be elements that contribute to the corrosion resistance and the processability.

As for the "inevitable impurities," it is possible to name impurities, which are included in raw materials, and impurities, which are mixed in upon casting. The "inevitable impurities" are elements that are difficult to remove because the cost or technical reasons. For example, as for such "inevitable impurities," it is possible to name Fe, K, Na, Cl, S, P, and Si.

In any case, in the newly established present invention, the compositions of "trace-amount modifying elements" and "inevitable impurities" are not limited in particular. Note that, even if an element is capable of turning into a "trace-amount modifying element," it is allowable to treat such an element as an inevitable impurity depending on the content or the application of resulting cast product.

Note that, in the case of pressure casting, the "die temperature" set forth in the newly established present invention designates a temperature that is measured by means of termocouple, which is buried inside the surface layer of metallic die's gate by 15 mm therefrom. In the case of gravity casting, the "die temperature" designates a surface temperature, which is measured at around the spure of metallic die or sand die.

BRIEF DESCRIPTION OF THE DRAWINGS

The patent or application file contains at least one drawing executed in color. Copies of this patent or patent application publication with color drawings will be provided by the Office upon request and payment of the necessary fee. A more complete appreciation of the present invention and many of its advantages will be readily obtained as the same becomes better understood by reference to the following detailed description when considered in connection with the accompanying drawings and detailed specification, all of which forms a part of the disclosure.

DETAILED DESCRIPTION OF THE PREFERRED EMBODIMENTS

Having generally described the present invention, a further understanding can be obtained by reference to the specific preferred embodiments which are provided herein for the purpose of illustration only and not intended to limit the scope of the appended claims.

EXAMPLES

The present invention will be hereinafter described in detail with reference to specific examples.

Example No. 1

A plurality of test samples were produced by changing the contents or addition amounts of Al, Ca and Mn in magnesium alloys variously. The resulting test samples were observed whether casting cracks occurred or not as well as for the structural roughness.

Production of Test Samples

A chloride flux was applied to the inner surface of a crucible. Note that the crucible was made of iron and was preheated in an electric furnace. A pure magnesium bare metal, pure Al and an Al—Mn alloy were charged into the crucible, and were melted therein. Note that the raw alloy materials were weighed by a predetermined mass, respectively. Moreover, Ca weighed by a predetermined weight was added to the resulting molten metal which was held at 750° C. (a molten metal preparing step).

The resultant molten metal was stirred fully to completely melt the raw materials. Thereafter, the molten metal was held still at the same temperature, 750° C., for a while. While melting the raw materials, a mixture gas of a carbon dioxide gas and an $SF_6$ gas was sprayed onto the surface of the molten metal in order to inhibit Mg from burning, and the flux was spread on the surface of the molten metal whenever appropriate.

Figure 1:
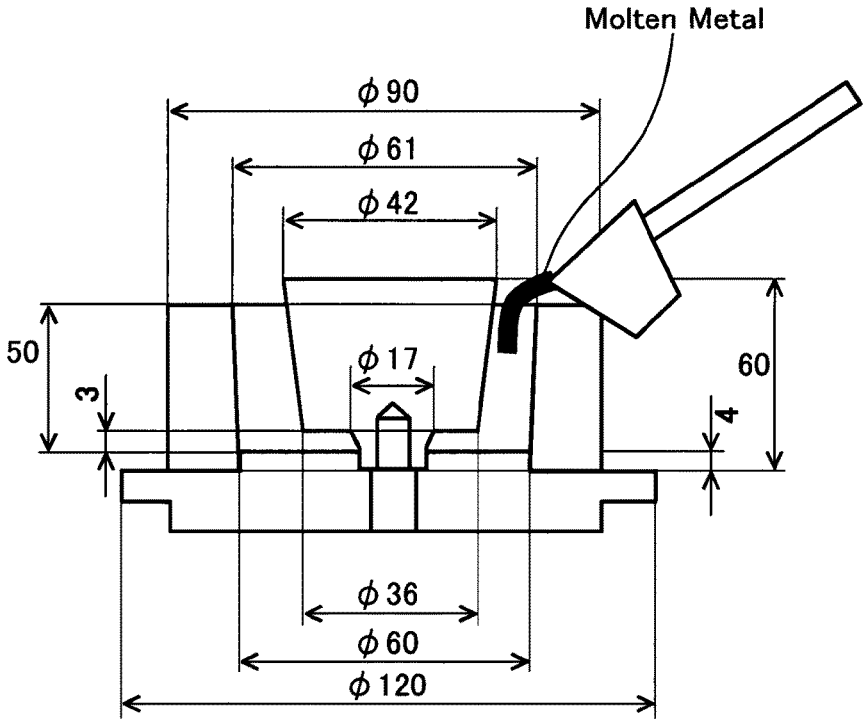
FIG. 1 is a cross-sectional view for illustrating the shape of a mold.

A variety of the thus produced molten alloys were poured into a mold which was formed as the configuration illustrated in FIG. 1 (a pouring step), and were solidified in air (a solidifying step). Thus, bottomed cylinder-shaped test samples (heat-resistant magnesium alloy cast products) were produced by the gravity casting. Note that the bottomed cylinder-shaped test samples had a bottom surface, whose thickness was about 3 mm and which was provided with a ϕ17 mm opening, and had an outside diameter of about ϕ60 mm. Table 1 below sets forth the chemical composition for every test sample.

Observation on Casting Cracks and Structural Roughness and Solidification Temperature Width Calculation The resulting test samples were observed for the occurrence of casting cracks and the type of casting cracks visually and by means of a metallographical microscope. When dendritic structures were formed in the fracture surface of casting cracks, the casting cracks were considered the hot cracks; and when the fracture surface was brittle fracture surfaces, the casting cracks were considered the shrinkage cracks. Table 1 sets forth the occurrence of casting cracks in the respective test samples together with the chemical compositions.

Moreover, the test samples were cut at the middle, and the structural roughness of the cut surface was observed by means of a metallographical microscope with 500 magnifications. Table 1 sets forth the results of the observation together with the other characteristics. Note that the structural roughness recited in Table 1 is an average structural roughness and is designated by an average crystalline grain diameter which was calculated from the average values of the size of α phases in Mg. For reference, FIGS. 2 (*a*) and 2 (*a*) depict the photographic image of the structure in Test Sample Nos. 5 and 7, respectively.

In addition, Table 1 sets forth the solidification temperature widths, which were calculated from the solidus temperature and liquidus temperature of the respective test samples, together with the above-described characteristics.

Figure 3:
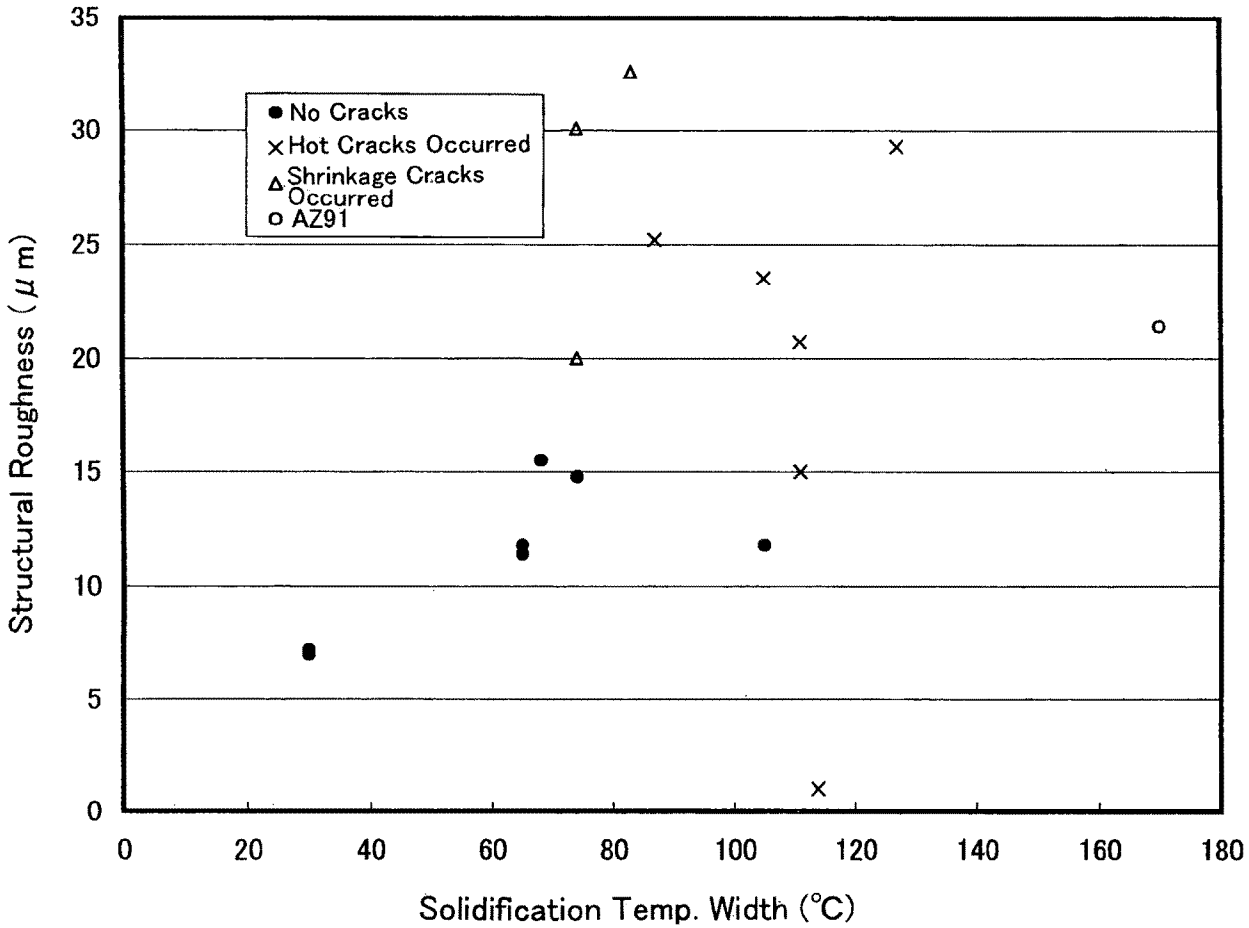
FIG. 3 is a scatter diagram for illustrating the solidification temperature width and structural roughness of test samples as well as whether casting cracks occurred or not in the test samples.

FIG. 3 summarizes the solidification temperature width, structural roughness and occurrence of casting cracks which were determined as described above.

TABLE 1

| Test Sample | Chemical Composition (% by mass) | | | | | | | Casting | Structural Roughness | Liquidus Temp. | Solidus Temp. | Solidification Temp. Width | |
|---|---|---|---|---|---|---|---|---|---|---|---|---|---|
| No. | Ca | Al | Mn | Zn | Sr | R.E. | Ca/Al | Cracks | (μm) | (° C.) | (° C.) | (° C.) | Remarks |
| 1 | 3 | 6 | — | — | — | — | 0.5 | None | 14.8 | 604 | 530 | 74 | |
| 2 | 3 | 9 | — | — | — | — | 0.3 | None | 15.5 | 598 | 530 | 68 | |
| 3 | 13.5 | 4.5 | — | — | — | — | 3.0 | None | 7 | 545 | 515 | 30 | |
| 4 | 3 | 3 | 0.2 | — | — | — | 1.0 | None | 11.8 | 620 | 515 | 105 | |

TABLE 1-continued

| Test Sample No. | Chemical Composition (% by mass) Ca | Al | Mn | Zn | Sr | R.E. | Ca/Al | Casting Cracks | Structural Roughness (μm) | Liquidus Temp. (° C.) | Solidus Temp. (° C.) | Solidification Temp. Width (° C.) | Remarks |
|---|---|---|---|---|---|---|---|---|---|---|---|---|---|
| 5 | 9 | 3 | 0.5 | — | — | — | 3.0 | None | 11.4 | 580 | 515 | 65 | Structural Photo: FIG. 2(a) |
| 6 | 9 | 3 | 0.7 | — | — | — | 3.0 | None | 11.8 | 585 | 515 | 65 | |
| 7 | 13.5 | 4.5 | 0.2 | — | — | — | 3.0 | None | 7.2 | 545 | 515 | 30 | Structural Photo: FIG. 2(b) |
| C1 | 1 | 1 | — | — | — | — | 1.0 | Hot Cracks | 29.3 | 642 | 515 | 127 | |
| C2 | 4 | — | — | — | — | — | — | Hot Cracks | 1 | 629 | 515 | 114 | |
| C3 | 3 | 3 | — | — | 0.3 | — | 1.0 | Hot Cracks | 15 | 626 | 515 | 111 | |
| C4 | 3 | 1 | — | — | — | 3 | 3.0 | Hot Cracks | 23.5 | 628 | 515 | 105 | |
| C5 | 3 | 3 | — | — | — | 3 | 1.0 | Hot Cracks | 20.7 | 626 | 515 | 111 | |
| C6 | 1 | 6 | — | — | — | 3 | 0.2 | Shrinkage Cracks | 20 | 60 | 530 | 74 | |
| C7 | 1 | 9 | — | — | — | 3 | 0.1 | Shrinkage Cracks | 32.6 | 598 | 515 | 83 | |
| C8 | 1 | 6 | — | 0.5 | — | 3 | 0.2 | Shrinkage Cracks | 30.1 | 60 | 53 | 74 | Japanese Unexamined Patent Publication (KOKAI) No. 2002-129,272 |
| C9 | 2 | 5 | 0.3 | — | — | 2 | 0.4 | Hot Cracks | 25.2 | 617 | 530 | 87 | Japanese Patent No. 3,229,954 |
| C10 | — | 9 | — | 1 | — | — | — | None | 21.4 | 598 | 428 | 170 | AZ91 |

Assessment

The following are appreciated from Table 1 and FIG. 3.

(1) The compositions of Test Sample Nos. 1 through 7 fell in the claimed ranges according to the present invention. As a result, all of Test Sample Nos. 1 through 7 exhibited a solidification temperature width of 105° C. or less, and were made finer so that they exhibited a structural roughness of 16 μm or less. Moreover, Test Sample Nos. 1 through 7 were little suffered from the occurrence of shrinkage cracks, not to mention hot cracks.

In addition, the more the Ca content was with respect to the Al content, namely, the larger the Ca/Al mass ratio was, Test Sample Nos. 1 through 7 exhibited a narrower solidification temperature width and simultaneously showed a finer structural roughness.

(2) The compositions of Test Sample Nos. C1 through C10 fell outside the claimed ranges according to the present invention. Except Test Sample No. C10, all of Test Sample Nos. C1 through C9 suffered from the occurrence of casting cracks. Note that it is believed that Test Sample No. C10 did not suffer from the occurrence of casting cracks because of the following fact. Since Test Sample No. C10 was made of an Mg—Al alloy whose heat resistance, especially creep resistance, was low inherently, it could deform easily by the stress in casting.

Test Sample Nos. C4 through C9 included "R.E." Accordingly, regardless of the solidification temperature width, all of Test Sample Nos. C4 through C9 exhibited a coarse structural roughness. Among Test Sample Nos. C4 through C9, test samples whose absolute Ca content was less and whose Al content was more with respect to the Ca content, such as Test Sample Nos. C6 through C8, exhibited a coarse structural roughness, though they exhibited a narrow solidification width. Moreover, Test Sample Nos. C6 through C8 suffered from the occurrence of casting cracks. Note that all of the casting cracks were shrinkage cracks in Test Sample Nos. C6 through C8.

Example No. 2

Production of Test Samples

An alloy molten metal whose target composition was Mg—3% Ca—3% Al—0.2% Mn was prepared by the above-described production process (a molten metal preparing step). The thus produced alloy molten metal was held at a temperature of from 620 to 630° C., and then die casting (or pressure casting specifically) was carried out.

A metallic die, which was used for die casting, was made from SKD11 (as per Japanese Industrial Standards (or JIS)). The metallic die was provided with a cavity, which was formed as a cup shape for automotive component part. Moreover, the metallic die's cavity inner peripheral wall had been subjected to a tungsten coating treatment.

Upon carrying out each die-casting operation, a die-releasing agent was applied onto the metallic die's cavity inner peripheral wall. Note that the die-releasing agent was a diluent, which was prepared by diluting a stock solution, "GRAFACE" produced by HANANO SHOJI Co., Ltd., to from 10 to 30 times by volume.

Before pouring the alloy molten metal into the metallic die, the metallic die was preheated to various temperatures. Then, the alloy molten metal was poured into the cavity of the metallic die through a nozzle (a pressure pouring step). Note that the alloy molten metal was pressurized at a plunger rate of from 1 to 1.5 m/min. Moreover, when pouring the alloy molten metal, the nozzle was held at a temperature of from 630 to 640° C.

The metallic die was water cooled. Note that the cooling rate was controlled to fall in a range of from 300 to 400° C./min. Moreover, the die time (hereinafter abbreviated to as "DT" wherever necessary), that is, the time elapsed from the pouring of alloy molten metal to the opening of metallic die, was controlled to fall in a range of from 0.5 to 2 seconds.

The above-described die casting was carried out repeatedly for every preheating temperature (or die temperature). Thus, test samples, which comprised 34 specific magnesium alloy cast products in total, were produced.

Note herein that the die temperature set forth in Example No. 2 designates temperatures which were measured at the inner side by 15 mm from the surface layer of the metallic die's gate.

Assessment

Figure 4:
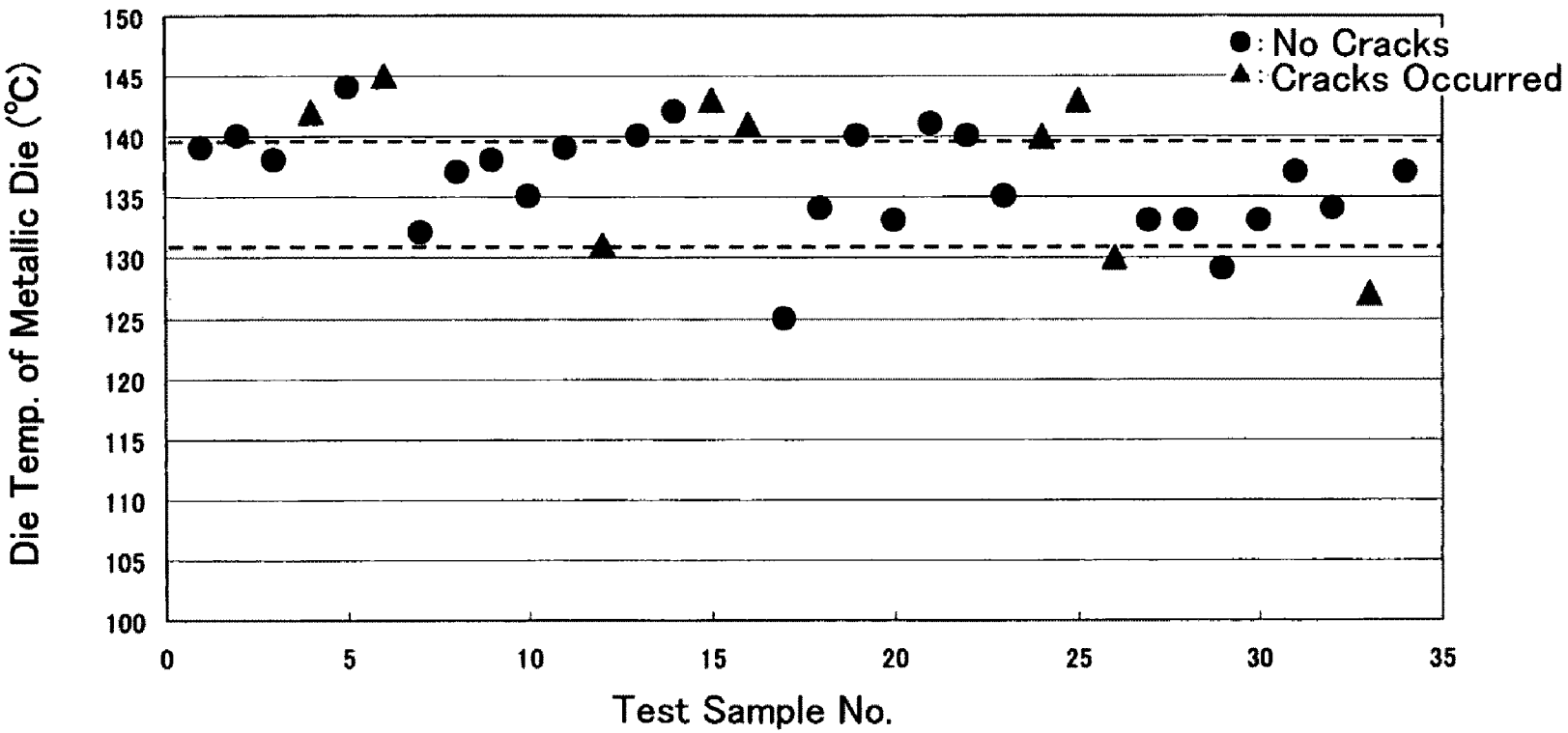
FIG. 4 is a scatter diagram for illustrating the relationships between the die temperatures of metallic die and the cast cracks when carrying out die casting.

The resulting respective test samples, that is, cast products, were observed for the presence or absence of cast cracks in order to examine the relationships between die temperatures and cast cracks. FIG. 4 illustrates the observed results.

As can be seen from FIG. 4, it was confirmed that cast cracks hardly occurred when the die temperature of the metallic die fell in a range of from 130 to 145° C. In particular, when the die temperature of the metallic die fell in a range of from 130 to 140° C., cast cracks did not occur at all.

Characteristics of Heat-Resistant Magnesium Alloy Cast Product

One of the test samples, which comprised a heat-resistant magnesium alloy being die cast while controlling the die temperature at 140° C., was designated as a representative cast product, and was examined for the characteristics. As a result, the representative cast product had an average crystalline particle diameter (or DAS) of from 1 to 10 μm, and exhibited a tensile strength of from 160 to 175 MPa.

Therefore, it is understood that the heat-resistant magnesium alloy cast products according to Example No. 2 exhibited sufficient strength and had a practical metallic structure.

Example No. 3

Production of Test Samples

An alloy molten metal whose target composition was Mg—3% Ca—3% Al—0.2% Mn was prepared by the above-described production process (a molten metal preparing step). The thus produced alloy molten metal was held at a temperature of from 740 to 750° C., and then gravity casting was carried out using a metallic die.

The used metallic die was made from cast iron. The metallic die was provided with a cavity, which was formed in the same manner as shown in FIG. 1.

Note that, in Example No. 3, a graphite-based die-releasing agent was applied onto the metallic die's cavity inner peripheral wall.

Before pouring the alloy molten metal into the metallic die, the metallic die was preheated to various temperatures. Then, the alloy molten metal was poured into the cavity of the metallic die under gravity (a gravity pouring step). Note that, in Example No. 3, the metallic die was cooled naturally.

The above-described gravity casting was carried out repeatedly for each of the die temperatures. Thus, test samples, which comprised 5 specific magnesium alloy cast products in total, were produced.

Note herein that the die temperature set forth in Example No. 3 designates surface temperatures, which were measured at around the metallic die's sprue.

Assessment

Figure 5:
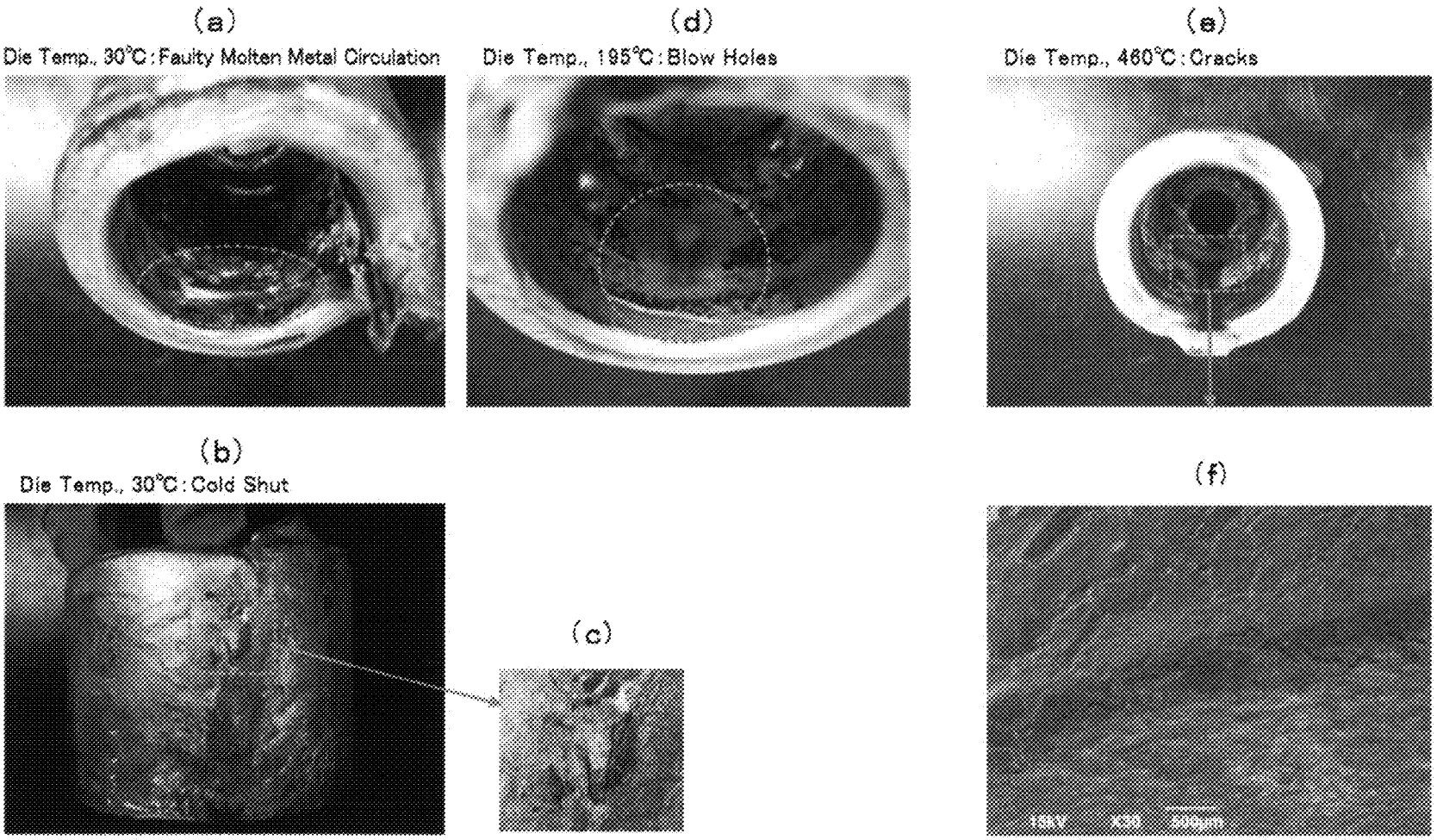
FIG. 5 is photographs for showing magnesium alloy cast products, which were produced while changing the die temperature of gravity-casting metallic die variously; wherein FIGS. 5(*a*), 5(*b*) and 5(*c*) show cast products being produced when the die temperature was set at 30° C.; wherein FIG. 5(*d*) shows a cast product being produced when the die temperature was set at 195° C.; wherein FIGS. 5(*e*) and 5(*f*) show a cast product being produced when the die temperature was set at 460° C.; wherein FIG. 5(*c*) is a partially enlarged photograph of the cast product shown in FIG. 5(*b*); and wherein FIG. 5(*f*) is a photomicrograph of the cast product shown in FIG. 5(*e*)

The resulting respective test samples, that is, cast products, were observed for the following features not only visually but also with a metallurgical microscope: the presence or absence of cold shut or the adequacy of molten-metal circulatability, the presence or absence of cast cracks, and the presence or absence of blow holes. Table 2 below summarizes the observed results. FIG. 5 illustrates the specific observations.

TABLE 2

| | Cast Defects | | |
|---|---|---|---|
| Die Temp. (° C.) | Presence or Absence of Cold Shut or Adequacy of Molten-metal Circulatability | Presence or Absence of Cast Cracks inside Bottom Surface | Presence or Absence of Blow Holes |
| 30 | X | ○ | ○ |
| 110 | ○ | ○ | ○ |
| 195 | ○ | ○ | X |
| 355 | ○ | ○ | X |
| 460 | ○ | X | X |

Note:
The symbol X designates that the feature was faulty or the defects were present.
The symbol ○ designates that the feature was satisfactory or the defects were absent.

As can be seen from Table 2 and FIG. 5, cold shut or faulty molten-metal circulation started arising when the die temperature was lower. On the contrary, blow holes started occurring when the die temperature heightened. Moreover, cast cracks came to occur when the die temperature became too high.

In the case of carrying out gravity casting using metallic die like Example No. 3, it was found out that the metallic die being preheated to a die temperature of from 30 to 450° C. inhibited the occurrence of cast defects. In particular, the metallic die being preheated to a die temperature of from 50 to 190° C. prevented the occurrence of overall cast defects.

Characteristics of Heat-Resistant Magnesium Alloy Cast Product

One of the test samples, which comprised a heat-resistant magnesium alloy being gravity cast while controlling the die temperature at 100° C., was designated as a representative cast product, and was examined for the characteristics. As a result, the representative cast product had an average crystalline particle diameter (or DAS) of from 10 to 50 μm, and exhibited a tensile strength of from 105 to 160 MPa.

Therefore, it is understood that the heat-resistant magnesium alloy cast products according to Example No. 3 exhibited sufficient strength and had a practical metallic structure.

Example No. 4

Production of Test Samples

An alloy molten metal whose target composition was Mg—3% Ca—3% Al—0.2% Mn was prepared by the above-described production process (a molten metal preparing step). The thus produced alloy molten metal was held at a temperature of from 740 to 750° C., and then gravity casting was carried out using a sand die.

The used sand die was made by gas curing a powder compact, which comprised a mixture of casting sand and binder. Note that the casting sand was "ALBANY SAND #7" produced by TOCHU Co., Ltd. Moreover, the binder was "KAO STEP C-810" produced by KAO QUAKER Co., Ltd.

In order to observe the molten-metal flowability or molten-metal circulatability of the alloy molten metal, the sand die was provided with a spiral-shaped cavity. Note that the spiral-shaped cavity had 8-mm width, 6-mm depth and 4-mm bottom-surface radius. Moreover, the spiral-shaped cavity comprised spiral arms, which were disposed at intervals of 7 mm and which went around by about four circuits in the sand die.

Before pouring the alloy molten metal into the sand die, the sand die was preheated to various temperatures. Then, the alloy molten metal was poured into the spiral-shaped cavity of the sand die under gravity (a gravity pouring step). Note that, in Example No. 4, the sand die was cooled naturally. Thus, test samples were produced using the sand die, which was preheated to various die temperatures. Moreover, in Example No. 4, the resultant test samples comprised 6 specific magnesium alloy cast products in total.

Note herein that the die temperature set forth in Example No. 4 designates surface temperatures, which were measured at around the sand die's sprue.

Assessment

Figure 6:
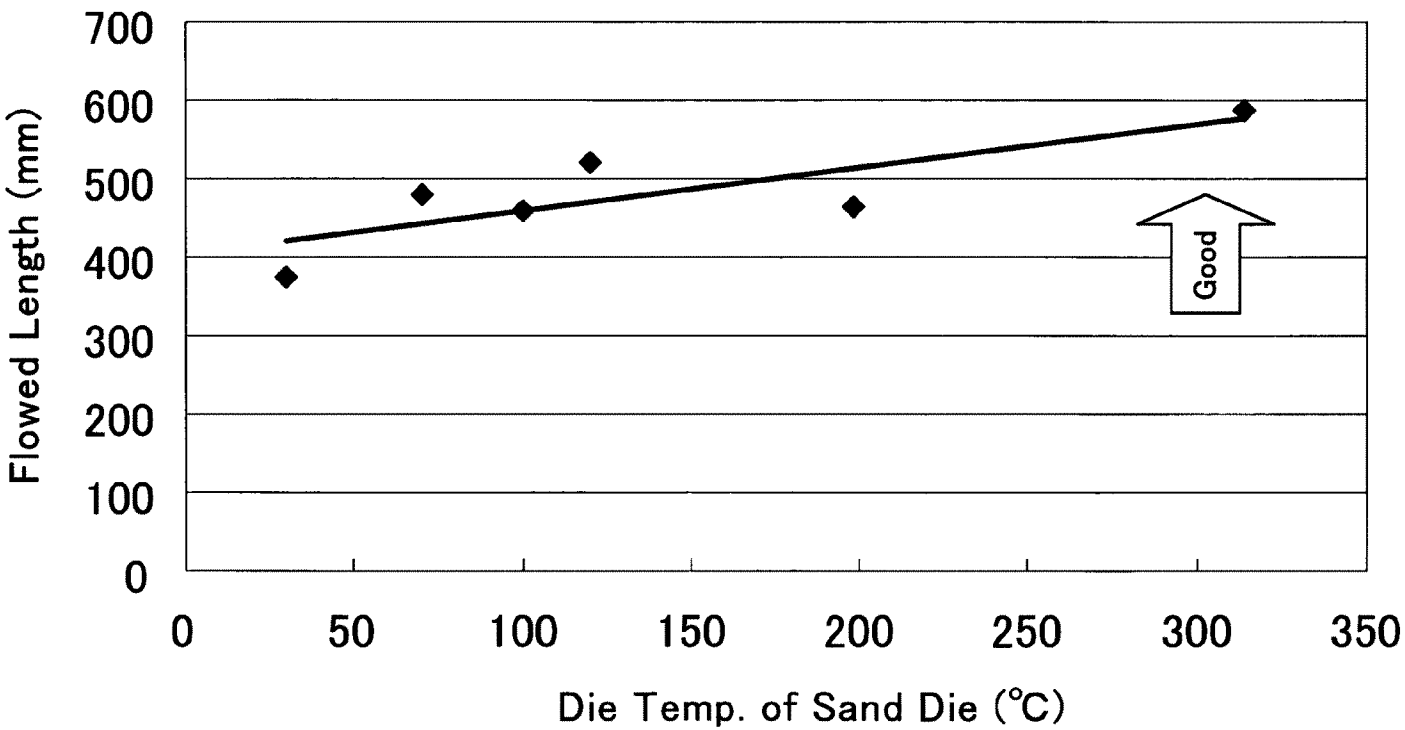
FIG. 6 is a graph for illustrating the relationships between the die temperatures of sand die and the molten-metal flowed lengths when carrying out gravity casting.
Figure 7:
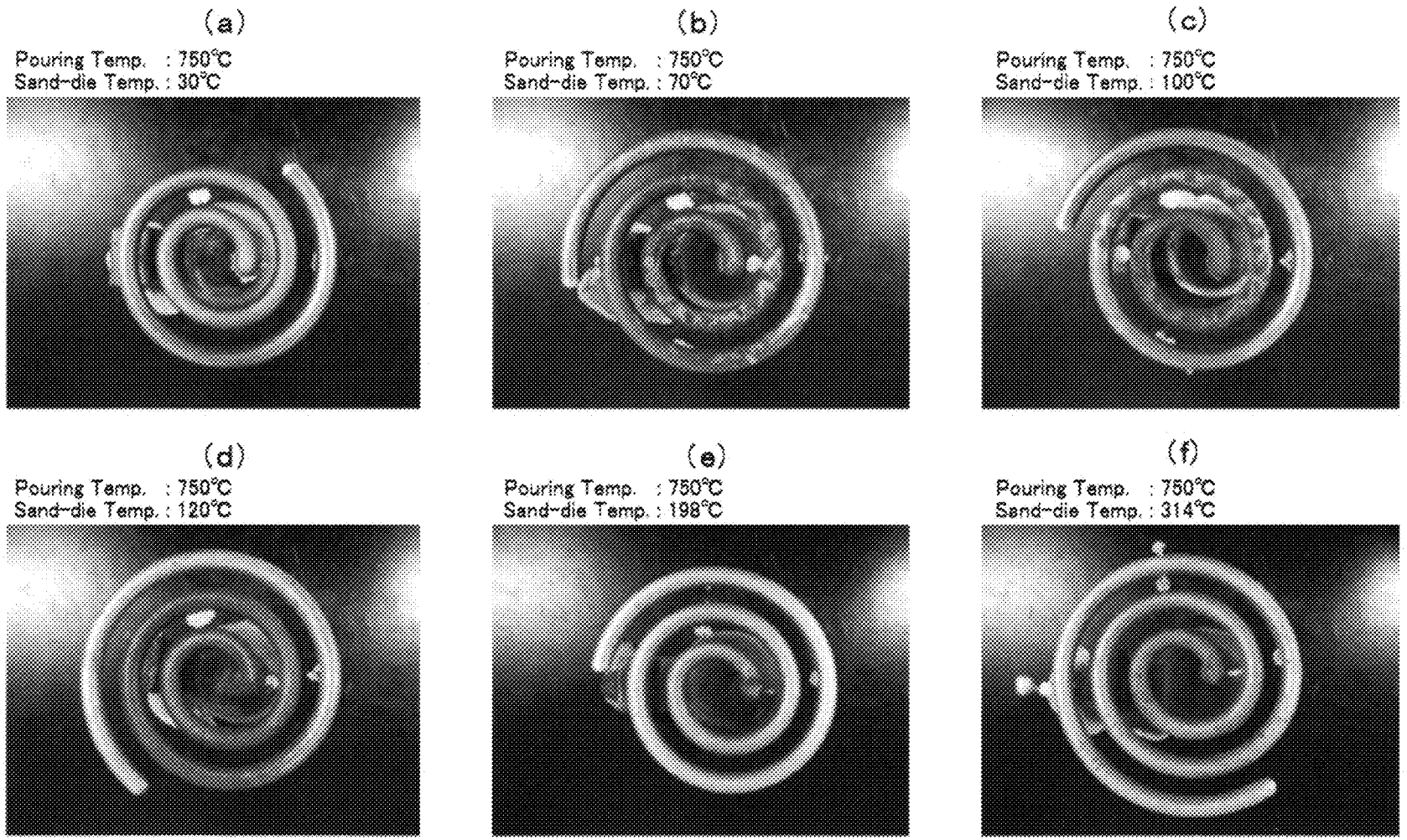
FIG. 7 is photographs for showing magnesium alloy cast products, which were produced while changing the die temperature of gravity-casting sand die variously; wherein FIG. 7(*a*) shows a cast product being produced when the die temperature was set at 30° C.; wherein FIG. 7(*b*) shows a cast product being produced when the die temperature was set at 70° C.; wherein FIG. 7(*c*) shows a cast product being produced when the die temperature was set at 100° C.; wherein FIG. 7(*d*) shows a cast product being produced when the die temperature was set at 120° C.; wherein FIG. 7(*e*) shows a cast product being produced when the die temperature was set at 198° C.; and wherein FIG. 7(*f*) shows a cast product being produced when the die temperature was set at 314° C.

The resulting respective test samples, that is, cast products, were observed for their lengths (or flowed lengths specifically) in order to examine the molten-metal circulatability of the alloy molten metal. Table 3 below summarizes the observed results. FIGS. 6 and 7 illustrate the specific observations.

TABLE 3

| | Die Temp. (° C.) | | | | | |
|---|---|---|---|---|---|---|
| | 30 | 70 | 100 | 120 | 198 | 314 |
| Flowed Length (mm) | 375 | 480 | 459 | 520 | 463 | 587 |

According to the observations, it was confirmed that the higher the die temperature was the longer the flowed length was and the better the molten-metal circulatability was exhibited. Therefore, when carrying out gravity casting using such a sand die, it is preferable that the die temperature can be 30° C. even at minimum.

However, there is an upper limit on the die temperature of sand die. As described above, a sand die comprises a mixture of casting sand and binder resin. The binder resin exhibits a relatively low heat-resistance temperature. Specifically, when the die temperature of sand die is increased too high, the binder resin degenerates partially so that the strength of sand die starts decreasing. Moreover, when the die temperature becomes a much higher temperature, the binder resin carbonizes or burns so that the shape of sand mold starts collapsing. The present inventors carried out an experiment repeatedly to study the phenomena.

Figure 8:
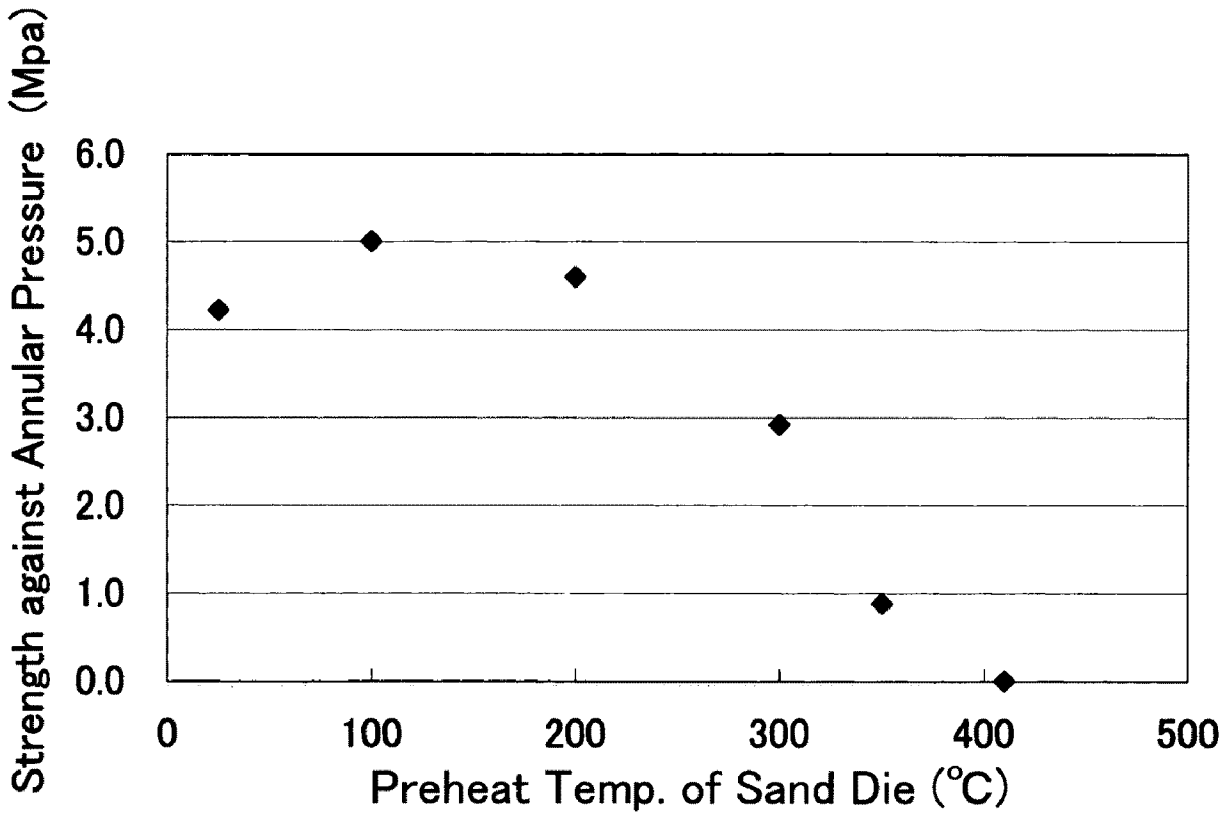
FIG. 8 is a scatter diagram for illustrating the relationships between the preheating temperatures of sand die, which was used in gravity casting, and the strengths thereof against annular pressure.

Table 4 below summarizes the results of the experiment. FIG. 8 illustrates the specific results. Note that the die temperature set forth in Table 4 and FIG. 8 designates the preheat temperatures of the sand die. The ambient temperatures within a heating furnace upon preheating the sand die were measured. Moreover, the sand die's strength against annular pressure was measured at room temperature after preheating the sand die at the respective die temperatures for 1 hour.

TABLE 4

| | Preheat Temp. (° C.) | | | | | |
|---|---|---|---|---|---|---|
| | 25 | 100 | 200 | 300 | 350 | 410 |
| Strength against Annular Pressure (MPa) | 4.2 | 5.0 | 4.6 | 2.9 | 0.9 | 0.0 |

According Table 4 and FIG. 8, it was confirmed that the strength of the sand die against annular pressure degraded greatly when the sand die was heated beyond 350° C. so that it became virtually difficult to carry out gravity casting. Moreover, according to a thermal analysis, it was revealed that the binder resin making the sand die started burning at around 400° C. (or 398° C. specifically). Note that the thermal analysis was carried out using the TG-DTA method in air.

As described above, it is apparent that the die temperature of sand die can preferably be controlled to fall in a range of from 30 to 350° C. In particular, it is more preferable to control the die temperature of sand die in a range of from 70 to 200° C. approximately.

Characteristics of Heat-Resistant Magnesium Alloy Cast Product

One of the test samples, which comprised a heat-resistant magnesium alloy being gravity cast while controlling the die temperature at 130° C., was designated as a representative cast product, and was examined for the characteristics. As a result, the representative cast product had an average crystalline particle diameter (or DAS) of from 40 to 80 μm, and exhibited a tensile strength of from 60 to 120 MPa.

Therefore, it is understood that the heat-resistant magnesium alloy cast products according to Example No. 4 exhibited sufficient strength and had a practical metallic structure.

Having now fully described the present invention, it will be apparent to one of ordinary skill in the art that many changes and modifications can be made thereto without departing from the spirit or scope of the present invention as set forth herein including the appended claims.

Figure Captions

Figure 2:
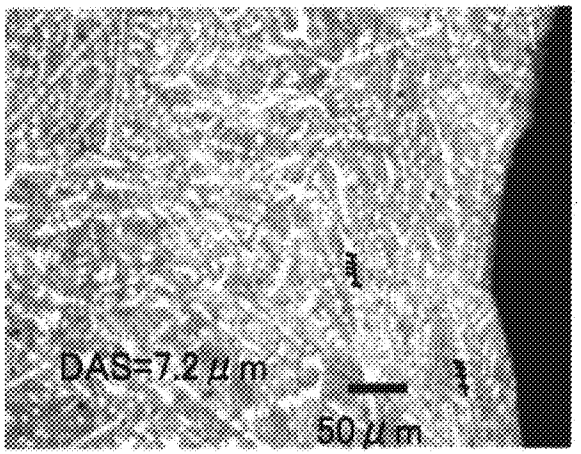
FIG. 2 is metallic structure photographs which were obtained by observing the cross-section of test samples with a metallographical microscope, wherein FIG. 2(*a*) is an image of the metallic structure of Test Sample No. 5 and FIG. 2(*b*) is an image of the metallic structure of Test Sample No. 7.

| | |
|---|---|
| FIG. 1: | Molten Metal |
| FIG. 2 (a): | (Test Sample No. 5) |
| FIG. 2 (b): | (Test Sample No. 7) |
| FIG. 3: | No Cracks<br>Hot Cracks Occurred<br>Shrinkage Cracks Occurred<br>Structural Roughness (μm)<br>Solidification Temp. Width (° C.) |

-continued

| Figure Captions | |
|---|---|
| FIG.4: | Die Temp. of Metallic Die (° C.)<br>Test Sample No.<br>No Cracks<br>Cracks Occurred |
| FIG.5: | (a) Die Temp., 30° C.: Faulty Molten Metal Circulation<br>(b) Die Temp., 30° C.: Cold Shut<br>(d) Die Temp., 195° C.: Blow Holes<br>(e) Die Temp., 460° C.: Cracks |
| FIG. 6: | Flowed Length (mm)<br>Die Temp. of Sand Die (° C.)<br>Good |
| FIG. 7: | (a) Pouring Temp.: 750° C.<br>Sand-die Temp.: 30° C.<br>(b) Pouring Temp.: 750° C.<br>Sand-die Temp.: 70° C.<br>(c) Pouring Temp.: 750° C.<br>Sand-die Temp.: 100° C.<br>(d) Pouring Temp.: 750° C.<br>Sand-die Temp.: 120° C.<br>(e) Pouring Temp.: 750° C.<br>Sand-die Temp.: 198° C.<br>(f) Pouring Temp.: 750° C.<br>Sand-die Temp.: 314° C. |

-continued

| Figure Captions | |
|---|---|
| FIG. 8: | Strength against Annular Pressure (MPa)<br>Preheat Temp. of Sand Die (° C.) |

What is claimed is:

1. A process for producing heat-resistant magnesium alloy cast product, the process comprising the steps of:

preparing an alloy molten metal including 2.5 to 3.5%-by-mass calcium (Ca), 2.5 to 3.5%-by-mass aluminum (Al), 0.1 to 0.5%-by-mass manganese (Mn) and the rest magnesium (Mg) as well as inevitable impurities and/or trace-amount reforming elements being effective for improving characteristics, wherein the temperature of the alloy molten metal falls in a range of 620 to 640° C.;

preheating a metallic casting die with a cavity provided therein, to a die temperature of 130 to 140° C.;

pressure pouring the alloy molten metal into the preheated metallic casting die with the cavity provided therein; and solidifying the alloy molten metal undergone the pouring step by cooling at a cooling rate of 300-400° C./minute, thereby obtaining the heat-resistant magnesium alloy cast product.

* * * * *